US005400228A

United States Patent [19]

Kao

[11] Patent Number: 5,400,228

[45] Date of Patent: Mar. 21, 1995

[54] FULL COLOR ILLUMINATING UNIT

[76] Inventor: Pin-Chi Kao, 5Fl., No. 539-3, Chungcheng Rd., Hsintien City, Taipei Hsien, Taiwan, Prov. of China

[21] Appl. No.: 273,640

[22] Filed: Jul. 12, 1994

[51] Int. Cl.[6] ..... F21V 21/00

[52] U.S. Cl. ..... 362/231; 362/249; 362/800

[58] Field of Search ..... 362/231, 249, 240, 252, 362/800

[56] References Cited

U.S. PATENT DOCUMENTS

| | | | |
|---|---|---|---|
| 4,677,533 | 6/1987 | McDermott et al. | 362/800 |
| 4,947,291 | 8/1990 | McDermott | 362/800 |
| 4,963,798 | 10/1990 | McDermott | 362/800 |
| 5,036,248 | 7/1991 | McEwan et al. | 362/800 |
| 5,039,832 | 8/1991 | Polacek et al. | 362/800 |
| 5,160,200 | 11/1992 | Cheselske | 362/249 |
| 5,161,879 | 11/1992 | McDermott | 362/231 |

*Primary Examiner*—Richard R. Cole
*Attorney, Agent, or Firm*—Welsh & Katz, Ltd.

[57] ABSTRACT

A full-color illuminating unit includes a first circuit board which is a disk having a hole and a plurality of green lights and red lights installed around the hole. A second circuit board which is a disk includes a blue light installed thereon. A first housing has an isolation plate integrally connected with an inner periphery thereof, thus separating the first housing into a first cavity and a second cavity. The first circuit board is installed in the first cavity while the second circuit board is installed in the second cavity. A boss protrudes from the isolation plate to the first cavity and is in communication between the first cavity and the second cavity. The first circuit board is positioned in place, with the periphery of the hole thereof being around the boss. The blue light is positioned in the boss, with a portion thereof protruding beyond an opening of the boss. A second housing is attached to the first housing, thus enclosing the second circuit board.

5 Claims, 4 Drawing Sheets

FULL COLOR ILLUMINATING UNIT

BACKGROUND OF THE INVENTION

The present invention relates to a full color illuminating unit many of which are installed on a plate thus forming a dot matrix display and, more particularly, to an improved full color illuminating unit comprising a blue light positioned in a first physical level and a plurality of red lights and green lights positioned in a second physical level around the blue light.

Conventional dot matrix displays, which employ red, green, and blue light emitting diodes (LED), are becoming more and more popular in advertising. The blue light emitting diodes, in addition to low emitting efficiency, are expensive and difficult to manufacture. The dot matrix display is limited to be used indoors since the brightness thereof is insufficient for outdoor use. Furthermore, the LED type dot matrix display, when used commercially, merely uses red and green LEDs upon economic consideration, and is thus unable to generate all kinds of colors. To eliminate the drawbacks of light emitting diodes, light bulbs of cathode ray type have been used for outdoor advertising. Yet the cathode-ray type light bulbs generate considerable heat and results in heat dissipation problems and affecting the life thereof. The inventor of the present invention has invented a full color dot matrix display and filed a foreign application with a serial number 83842/4. Referring to FIG. 4, the 83842/4 application discloses a full color dot matrix display which comprises a housing 90 including a front panel 81 and a rear plate 82, a first circuit board 96 and a second circuit board 97 provided between the front panel 81 and the rear plate 82, and a plurality of illuminating units 9 arranged in the form of a dot matrix and is mounted on the first circuit board 96 and the second circuit board 97.

Further referring to FIG. 4 and FIG. 5, each illuminating unit 9 comprises a substrate 91, a central blue light bulb 94 of cathode ray type mounted in a central hole 92 in the substrate 91, and a plurality of red and green light emitting diodes 93 (LEDs) mounted around the blue light bulb 94. The LEDs 93 are electrically connected to the first circuit board 96 by pins 95 on the substrate 91. The blue light bulb 94 extends beyond the substrate 91 through a hole 220 in the first circuit board 96 and electrically connects to the second circuit board 97.

However, there are some drawbacks existing in the above example. Firstly, the color combination can not achieve uniformality in some angular ranges. This is because the blue light from the cathode ray type bulb is visible in an angular range up to 75° with respect to a longitudinal central line thereof, yet the light (either red and green) from the LED is visible in another angular range up to 30° as illustrated in FIG. 6. For the above reason, the combination light is not uniform in an angular range from 30° to 75° which is called "non-uniform range". Therefore, any person who stands in the "non-uniform range" will see blue light only. Secondly, the blue light bulb 94 is firmly confined between the first circuit board 96 and the second circuit board 97, thus it is cumbersome to replace a broken blue light bulb 94 in this structure. Unfortunately, the blue light bulb 94 normally has two to three year life time. Thirdly, the display housing 90 is normally installed outdoors and is apt to be splashed by rain, thus any of the illuminating units 9 might get wet and the bulbs therein might be damaged.

Therefore, there has been an unfulfilled need for an improved full color dot matrix display to mitigate and/or obviate the aforementioned problems.

SUMMARY OF THE INVENTION

An object of the present invention is to provide an improved full color illuminating unit which provides a uniform color light mixing effect.

Another object of the present invention is to provide an improved illuminating unit which is resistant to rain, moisture etc.

In accordance with one aspect of the present invention there is provided a full color illuminating unit, a plurality of which are installed in a dot matrix display and each comprises a first circuit board which is a disk having a hole and a plurality of green lights and red lights installed around the hole. A second circuit board which is a disk includes a blue light installed thereon. A first housing has an isolation plate integrally connected with an inner periphery thereof thus separating the first housing to a first cavity and a second cavity. The first circuit board is installed in the first cavity while the second circuit board is installed in the second cavity. A boss protrudes from the isolation plate to the first cavity and is in communication between the first cavity and the second cavity. The first circuit board is positioned in place, with the periphery of the hole thereof being around the boss. The blue light is positioned in the boss, with a portion thereof protruding beyond an opening of the boss. A second housing is attached to the first housing thus enclosing the second circuit board.

Other advantages and novel features of the invention will become more apparent from the following detailed description when taken in conjunction with the accompanying drawings.

DETAILED DESCRIPTION OF THE PREFERRED EMBODIMENT

Figures 1, 2:
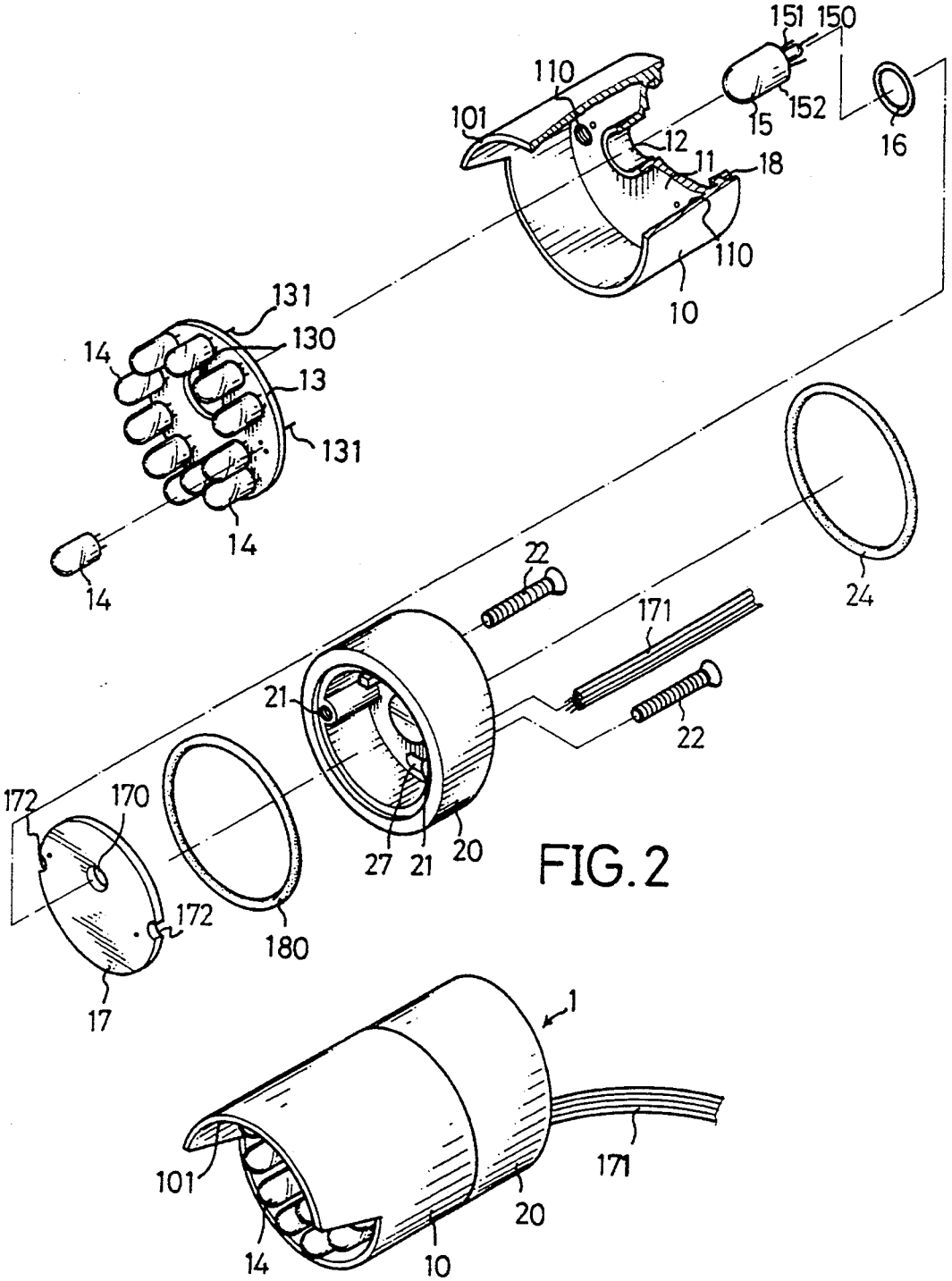
FIG. 1 is a perspective view of a full color illuminating unit in accordance with the present invention.
FIG. 2 is an exploded view of FIG. 1.

Referring to FIGS. 1 and 2, a full-color illuminating unit 1 in accordance with the present invention comprises a first housing means 10 and a second housing means 20. The first housing means 10 and the second housing means 20 are substantially cylindrical barrels. The first housing means 10 has an isolation plate 11 formed near one end thereof, thereby defining a relatively large cavity and a relatively small cavity in two sides thereof. An annular protrusion 18 extends from one side of the isolation plate 11 and isolates the relatively small cavity into a first recess therein and a second recess thereout. More particularly, the second recess is defined between the annular protrusion 18 and an end periphery of the first housing means 10. A boss 12 extends from one side of the isolation plate 11 and locates in the scope of the relatively large cavity. A protrusion 101 extends from one end of the first housing means 10 for concentrating any light emitted from the relatively large cavity. A first circuit board 13 has a hole 130 formed therein for accepting the boss 12 in position. A plurality of LEDs 14 including red LEDs and green LEDs are soldered on the first circuit board 13, around the hole 130. A plurality of conductive pins 131 extend from the first circuit board 13. A blue bulb 15 of cathode ray type is received in the boss 12. The cathode ray type bulb 15 has a body portion 152 and a neck portion 150 protruding therefrom thus forming a shoulder therebetween. Two pins 151 also protrude from the body portion 152 substantially parallel to the neck portion 150. A ring seal 16 encloses the body portion 152 of the cathode ray type bulb 15 and is firmly positioned in the boss 12 preventing water from passing through the boss 12. A second circuit board 17 is adapted to be received in the first recess of the first housing means 10. The second circuit board 17 has a hole 170 therethrough for receiving the neck portion 150 of the cathode ray type bulb 15. The shoulder of the cathode ray type bulb 15 abuts against the second circuit board 17 when the neck 150 of the bulb 152 is received in the hole 170 of the second circuit board 17. The isolation plate 11 and the second circuit board 17 each has a plurality of small holes (not labeled) allowing the conductive pins 131 from the first circuit board 13 to pass therethrough and electrically connect to the second circuit board 17.

The second housing means 20 has two bosses 21 formed diametrically opposite in the inner periphery thereof. Each boss 21 has a hole therethrough. Two threaded holes 110 are formed through the isolation plate 11 and each corresponds to one of the bosses 21 respectively. Two holes 172 are formed in the periphery of the second circuit board 17 and each corresponds to one of the bosses 21 respectively. Two screws 22 are threaded into the two threaded holes 110 through the two bosses 21 and the two holes 172 for engaging the first housing means 10 and the second housing means 20 together. Although the first housing means 10 and the second housing means 20 are engaged by the two screws 22, the intersection therebetween may be invaded by water. Therefore, a ring seal 180 is received in the second recess of the first housing means 10 preventing any water from entering the intersection of the first housing means 10 and the second housing means 20. The second housing means 20 has an annular recess 23 (see FIG. 3) formed in an outer bottom thereof for receiving a ring seal 24 therein.

Figure 3:
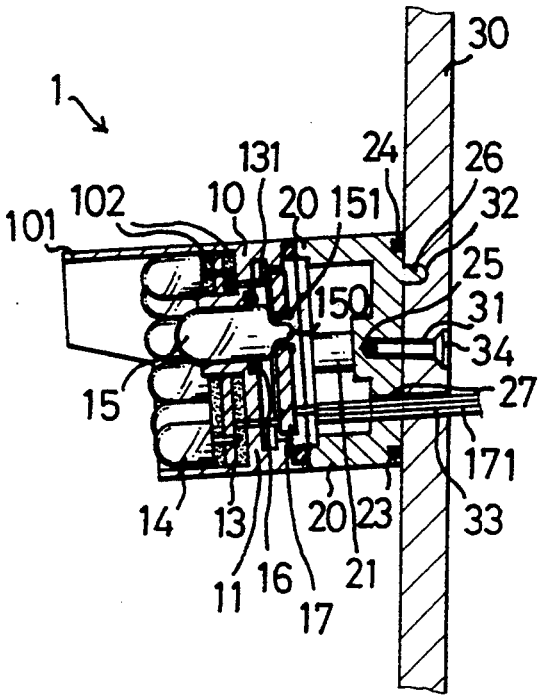
FIG. 3 is a cross-sectional view of the illuminating unit of FIG. 1.
Figure 5:
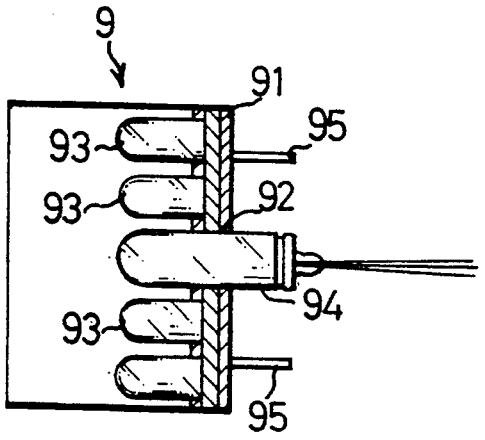
FIG. 5 PRIOR ART
FIG. 5 is a cross-sectional view of a conventional illuminating unit.
Figure 4:
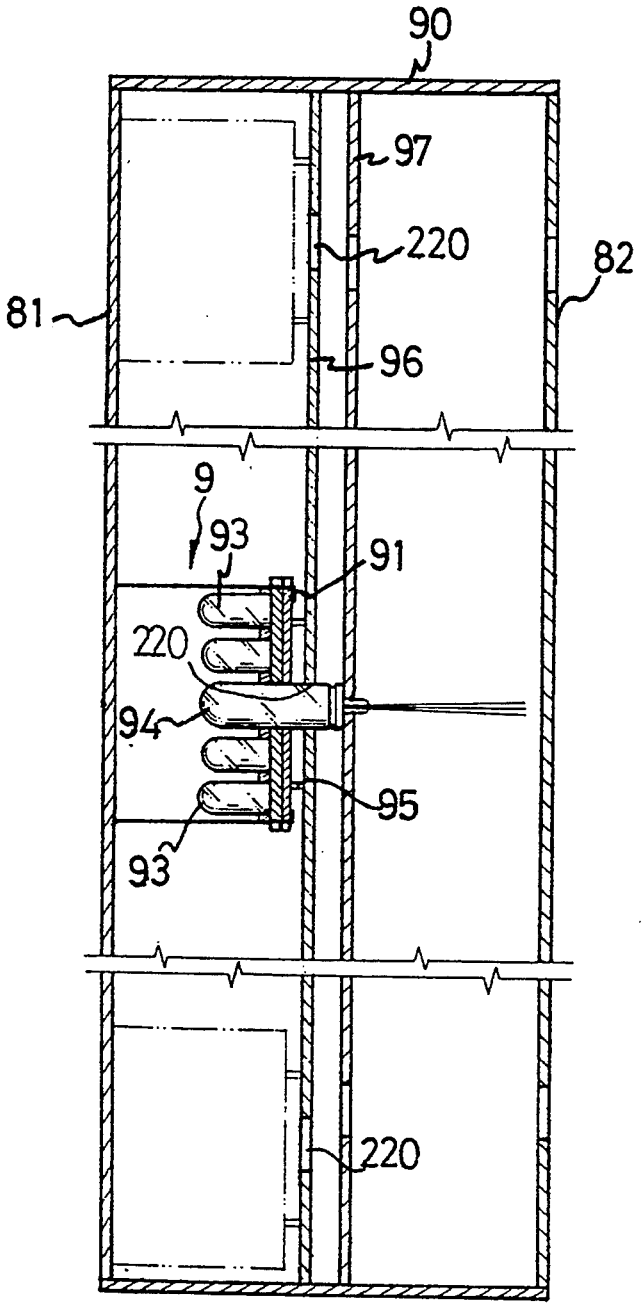
FIG. 4 PRIOR ART
FIG. 4 is a schematic cross-sectional view of a dot matrix display installed with the conventional full color illuminating units.
Figure 6:
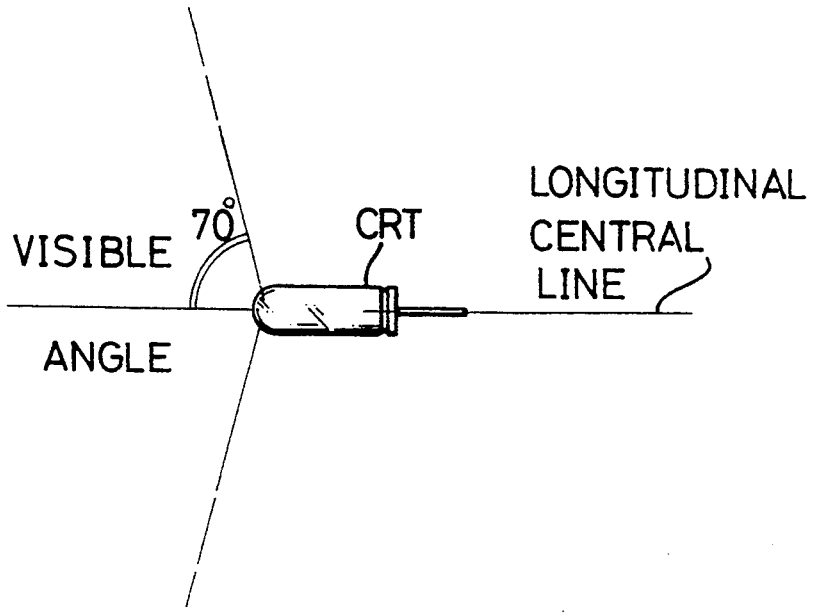
FIG. 6 illustrates the visible angles of a cathode ray type bulb and a light emitting diode.
Figure 6:
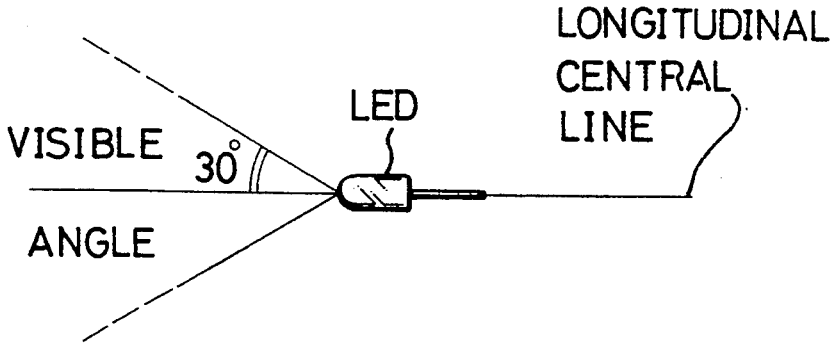

Also referring to FIG. 3, a water-proof sealant 102 is respectively coated at two sides of the first circuit board 13. It can be seen that the head portions of the LEDs 14 together are in an imaginary plane which is intersected with an opening periphery of the first housing means 10, while the head of the blue bulb 15 falls inside the first housing means 10. In other words, the head portions of the LEDs 14 are in a relatively front physical level and the head portion of the cathode ray bulb 15 is in a relatively rear physical level. This structure will not generate unwanted blue light, since the visible angle of the cathode ray bulb 15 is limited in the first housing means 10. A threaded hole 25 is formed at an outer bottom of the second housing means 20. A lug 26 is formed at an outer bottom portion of the second housing means 20. A bundle of cables 171 extend from one side of the second circuit board 17. A hole 27 is also formed at the bottom of second housing means 20 allowing the cables 171 to pass therethrough. A rear plate 30 is used to fix the illuminating unit 1 thereon. The rear plate 30 has a plurality of identical unit area each for fixing an illuminating unit 1 thereon. Responding to the structure of the bottom of the second housing means 20 each unit area comprises a recess 32 for receiving the lug 26, a hole 31 corresponding to the threaded hole 25 of the second housing means 20 and both allow a screw 34 to engage therethrough, thereby fixing the illuminating unit 1 on the rear plate 30, and a hole 33 corresponding to the hole 27 thus allowing the cables 171 to pass therethrough and be connected to a power source (not shown). It is very clear that the ring seal 24 may prevent water from entering the intersection of the bottom of the second housing means 20 and the rear plate 30. Since the dot matrix display is usually positioned in a relatively high place of a building or the like, therefore the bottom of the second housing means 20 is a slope and the light emitted from the illuminating unit 1 can project to ground in an appropriate angle. The protrusion 101 of the illuminating unit 1 may block sunlight which decreases the visibility of the light from the illuminating unit 1.

Although the invention has been explained in relation to its preferred embodiment, it is to be understood that many other possible modifications and variations can be made without departing from the spirit and scope of the invention as hereinafter claimed.

I claim:

1. A full-color illuminating unit comprising a first circuit board which is a disk having a hole and a plurality of green lights and red lights installed around said hole;

a second circuit board which is a disk including a blue light installed thereon;

a first housing means comprising an isolation plate integrally connected with an inner periphery thereof, thus separating said first housing means into a first cavity and a second cavity, a first boss protruding from said isolation plate to said first cavity, said first cavity and said second cavity being in communication with each other via said boss, said first circuit board being positioned in place, with the hole thereof receiving said boss, said blue light positioned in said boss, with a portion thereof protruding beyond an opening of said boss, an annular protrusion extending from said isolation plate thus separating said second cavity into a first recess enclosed in said annular protrusion and a second recess out of said annular protrusion, said second circuit board being received in said first recess, a ring seal being received in said second recess; and a second housing means substantially being a barrel firmly attached to said first housing means, thus enclosing said second circuit board.

2. The full-color illuminating unit as claimed in claim 1, wherein said second housing means has two second bosses formed in an inner periphery thereof and opposite to each other, each boss having a hole therethrough, and said first housing means has two threaded holes formed in the isolation plate each corresponding to one of said second bosses, and two screws each respectively threaded into said corresponding pair of holes, thereby firmly attaching said second housing means to said first housing means.

3. The full-color illuminating unit as claimed in claim 1, wherein said first housing means has a protrusion extending from one end of the first housing means for concentrating any light emitted therefrom.

4. The full-color illuminating unit as claimed in claim 1, wherein said green lights and red lights are light emitting diodes.

5. The full-color illuminating unit as claimed in claim 1, wherein said blue light is a cathode ray type bulb.

* * * * *